US006568378B2

(12) United States Patent
Baek

(10) Patent No.: US 6,568,378 B2
(45) Date of Patent: May 27, 2003

(54) ENGINE CHAIN COVER

(75) Inventor: Hong-Kil Baek, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/174,647

(22) Filed: Jun. 18, 2002

(65) Prior Publication Data

US 2002/0195091 A1 Dec. 26, 2002

(30) Foreign Application Priority Data

Jun. 25, 2001 (KR) ..... 2001-36142

(51) Int. Cl.[7] ..... F01M 13/00
(52) U.S. Cl. ..... 123/572
(58) Field of Search ..... 123/572, 573, 123/574, 41.86, 195 C

(56) References Cited

U.S. PATENT DOCUMENTS

| | | | | |
|---|---|---|---|---|
| 4,681,068 A | | 7/1987 | Anno et al. | |
| 4,958,613 A | | 9/1990 | Hiraoka et al. | |
| 4,998,515 A | | 3/1991 | Carvalho | |
| 5,148,784 A | | 9/1992 | Hiraoka et al. | |
| 5,647,315 A | | 7/1997 | Saito | |
| 5,809,963 A | | 9/1998 | Saito | |
| 5,887,565 A | | 3/1999 | Ozeki et al. | |
| 6,065,458 A | * | 5/2000 | Ozeki | 123/572 |
| 6,098,603 A | | 8/2000 | Maegawa et al. | |
| 6,182,624 B1 | | 2/2001 | Ozeki | |
| 6,182,625 B1 | | 2/2001 | Ozeki | |
| 6,213,078 B1 | | 4/2001 | Ryu | |
| 6,247,464 B1 | | 6/2001 | Maegawa et al. | |
| 6,279,554 B1 | * | 8/2001 | Sayama et al. | 123/572 |
| 6,308,679 B1 | | 10/2001 | Nakamura et al. | |
| 6,338,329 B2 | | 1/2002 | Maegawa et al. | |

FOREIGN PATENT DOCUMENTS

EP 1031704 A2 8/2000

* cited by examiner

*Primary Examiner*—Marguerite McMahon
(74) *Attorney, Agent, or Firm*—Pennie & Edmonds LLP

(57) ABSTRACT

An engine chain cover wherein a passage for passing the blow-by gas is formed at one side of the chain cover to shorten the manufacturing process of a cylinder head and save manufacturing costs, and some of the oil is separated from the blow-by gas when the blow-by gas passes through the passage of the chain cover to thereby improve the separation efficiency of the oil.

8 Claims, 4 Drawing Sheets

ENGINE CHAIN COVER

FIELD OF THE INVENTION

The present invention relates to an engine chain cover, and more particularly to an engine chain cover adapted to additionally function as a passage for blow-by gas generated from an engine crankcase.

BACKGROUND OF THE INVENTION

In general, a certain amount of blow-by gas leaks into the crankcase from the combustion chamber while an engine is running, whereby engine oil is thinned down or changed in quality by influences such as heat, moisture in the blow-by gas, thereby generating sludge.

In order to prevent this phenomenon, a ventilation device known as breather is mounted at a crankcase to discharge the blow-by gas into the atmosphere. The blow-by gas, however, contains a large amount of hydrocarbons or carbureted hydrogen to become a source of air pollution such that a positive crankcase ventilation device is used to forcibly introduce the blow-by gas into the suction system of the engine and again send same to the combustion chamber for combustion.

In other words, blow-by gas generated from a cylinder block is induced to flow into the head cover of the engine through passages provided in the cylinder head, where oil is separated from blow-by gas to be re-cycled to an oil pan. The blow-by gas removed of oil is burnt again in the combustion chamber of the engine. However, past attempts to address such problems have generally resulted in increased manufacturing cost of the cylinder head and difficulty in processing.

SUMMARY OF THE INVENTION

The present invention provides an engine chain cover capable of inducing the blow-by gas collected at the crankcase to flow into an upper portion of the engine. In accordance with an embodiment of the present invention, there is provided an engine chain cover formed with a passage for inducing the blow-by gas collected at a crankcase into an interior portion of a head cover mounted above a cylinder head. The passage comprises a groove vertically formed at one side of the chain cover, and a plate for blocking an open side of the groove to form the passage.

In an alternative preferred embodiment, the cover comprises an outer cover member having a raised portion to define a grove therein. The raised portion is configured and dimensioned such that when mounted on the engine the groove extends from a position proximate the crankcase to a position proximate the cylinder head. An inner plate covers the groove to define a blow-by gas passage therethrough. The plate is configured and dimensioned to define an inlet proximate the crankcase and an outlet proximate the cylinder head. Also, a seal is provided at the outlet adapted to seal against the cylinder head. Ribs may also be provided for stiffening the plate.

In a further preferred embodiment, the cover thus described is provided in combination with an engine. In this embodiment, a head cover is mounted on the cylinder head and defining a space therein. A hole is defined by the cylinder head and provides communication between the head cover space and the chain cover passage. The cover seals around the hole such that blow-by gas may pass from the crankcase through the inlet to the head cover space via the chain cover passage and the hole. Preferably the cylinder head defines a single hole communicating with the chain cover, although more may be provided as designated by a person skilled in the art.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

An embodiment of the present invention will now be described in detail with reference to the accompanying drawings.

Figure 1:
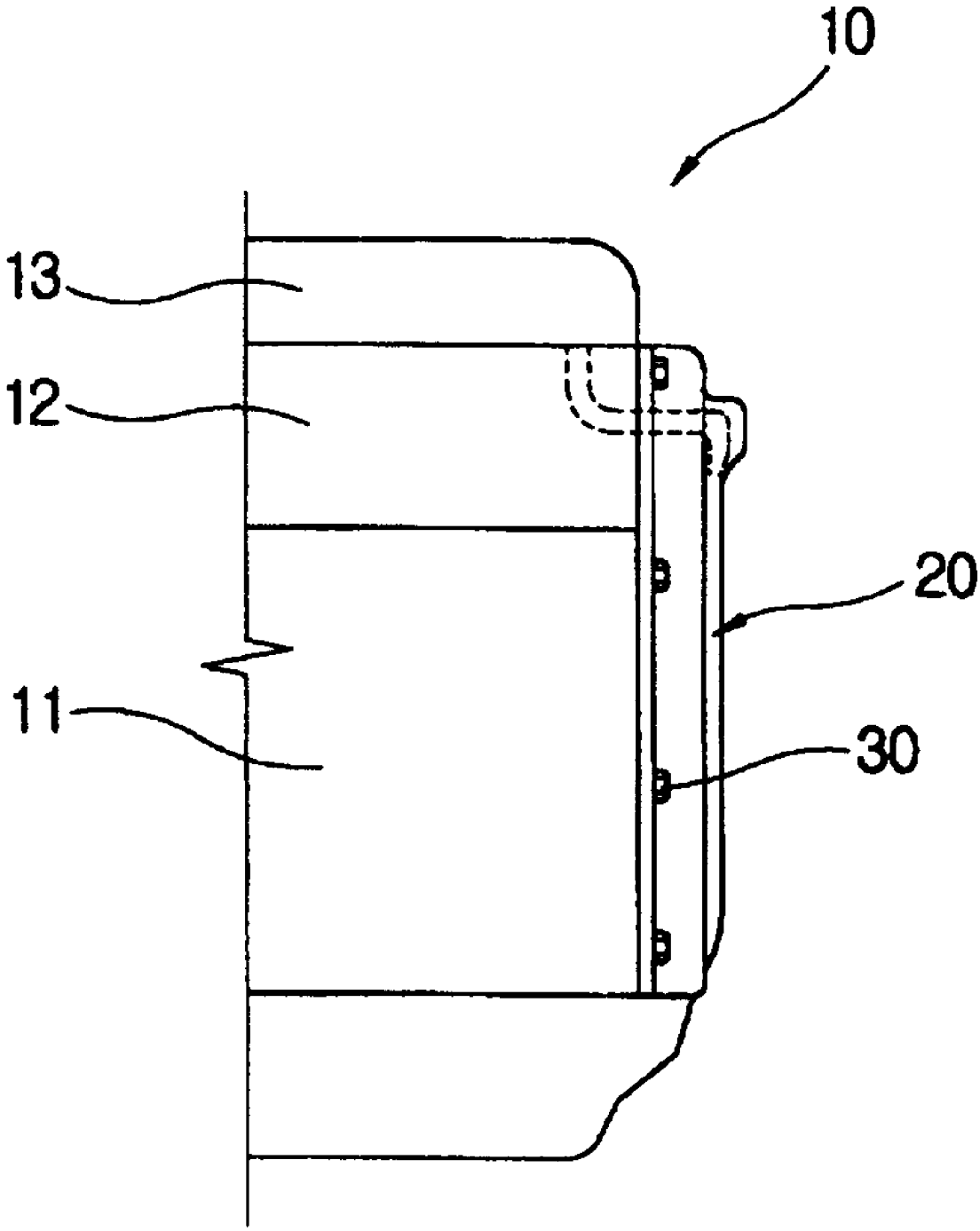
FIG. 1 is a schematic drawing illustrating a chain cover formed according to an embodiment of the present invention is mounted with a cylinder block and a cylinder head.
Figure 2:
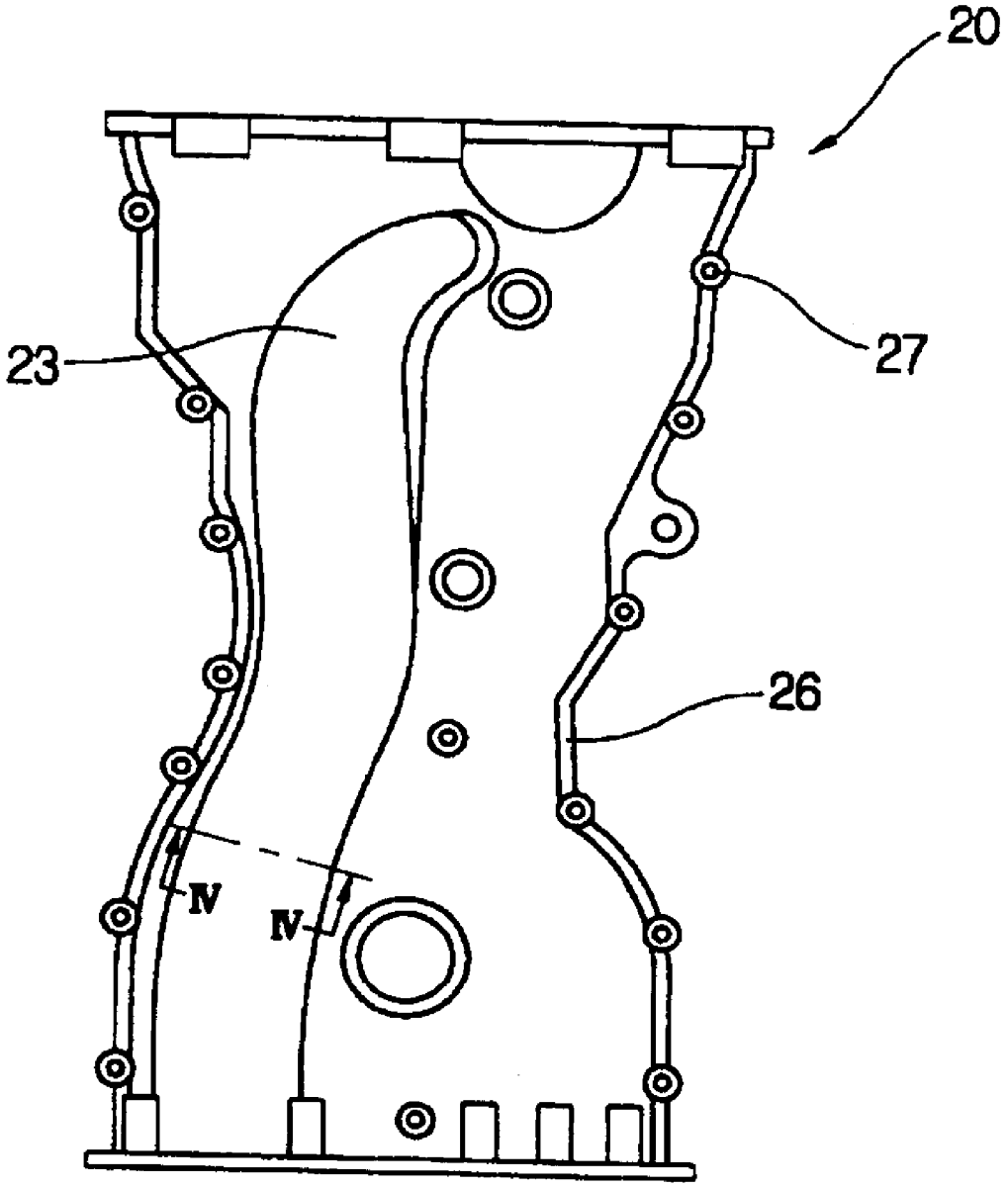
FIG. 2 is a front view of a chain cover according to the present invention.

Referring to FIG. 1, a chain cover 20 according to an embodiment of the present invention is mounted at one side of an engine 10 in order to protect a chain for transmitting a driving force of a crank shaft. The chain cover 20 is preferably made of relatively light material and is installed on a cylinder block 11 and a cylinder head 12 via at least one bolt 30.

Chain cover 20 is further formed with a passage 22 for passing the blow-by gas as shown in FIGS. 2–5. In order to form the passage 22, the chain cover 20 is vertically formed with a raised portion to define a groove 21. The groove formed by raised portion 21 is covered at an open side thereof by a separately-formed plate 23 to thereby form the passage 22 through which the blow-by gas passes. It may be preferable to form a plurality of ribs 24 along the plate 23 in order to add strength and stiffness.

Figure 3:
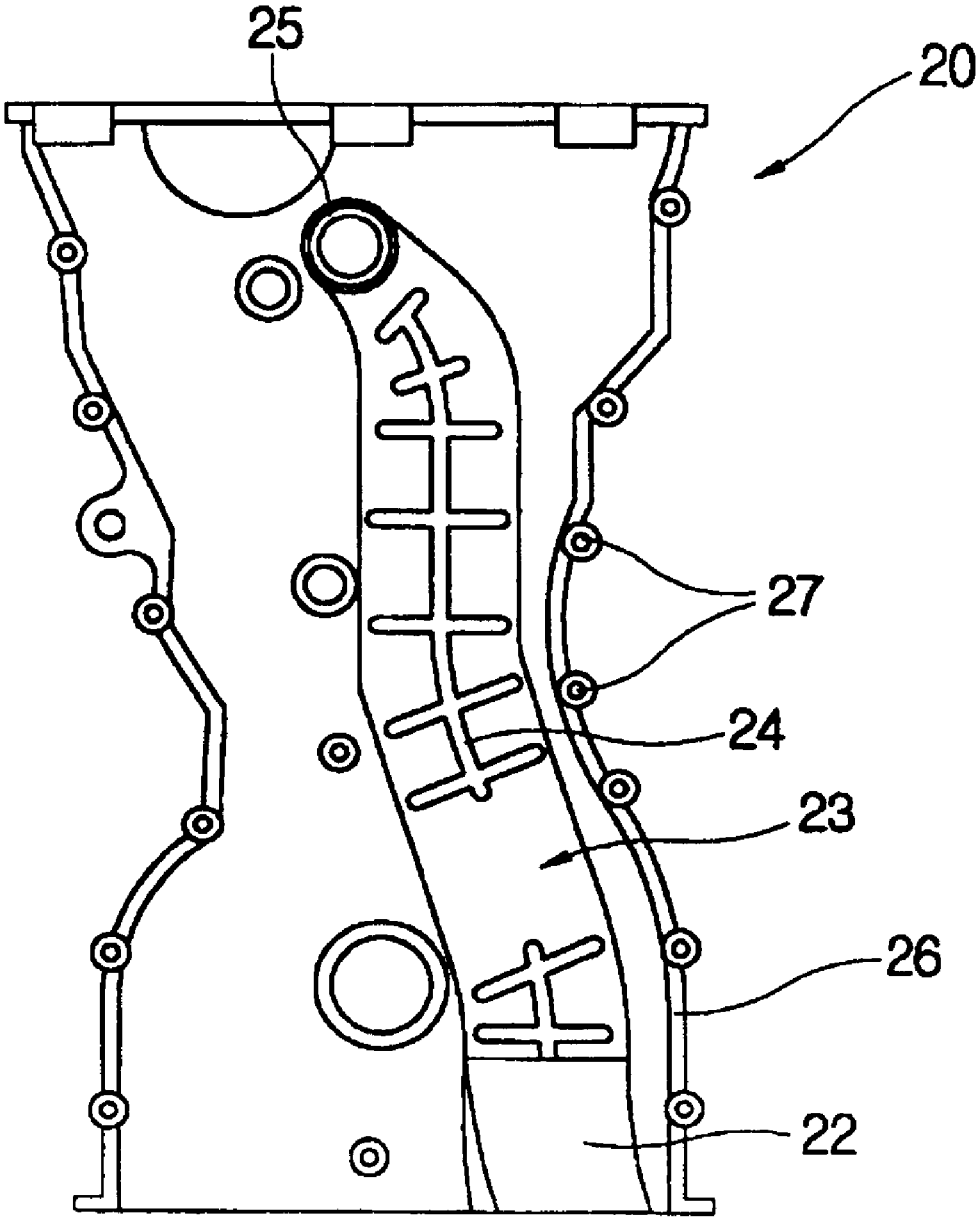
FIG. 3 is a rear view of a chain cover according to the present invention.
Figure 4:
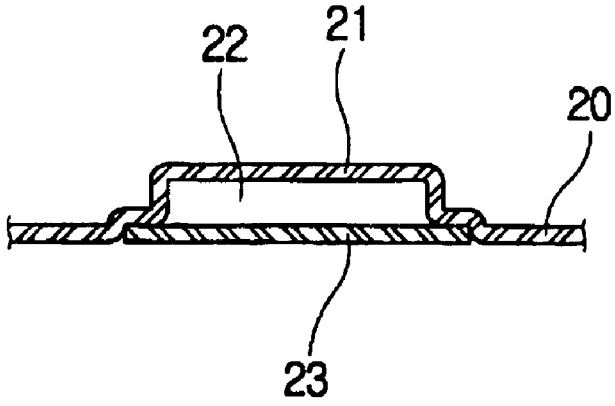
FIG. 4 is a cross-sectional view taken along line IV—IV of FIG. 2.
Figure 5:
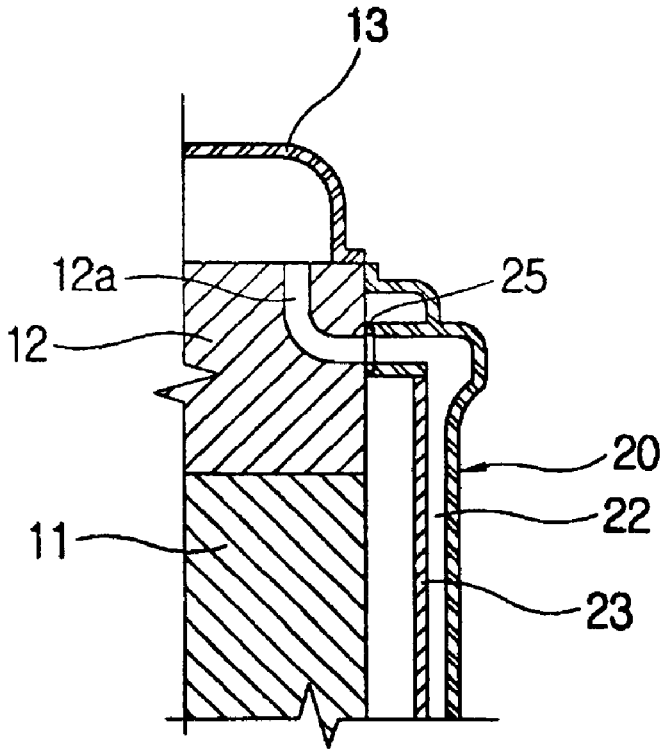
FIG. 5 is a cross-sectional detailed view showing the chain cover mounted at a cylinder head according to the present invention.

As best seen in FIG. 3, passage 22 opens at a lower portion thereof for the blow-by gas collected at a lower portion of crankcase to be induced into the passage 22. The passage 22 communicates with a hole 12*a* formed at one side of the cylinder head 12. The hole 12*a* is formed to induce the blow-by gas, having passed through the passage 22, to flow into head cover 13. A packing 25 is installed at an area where an upper end of the passage 22 connects at the entry of the hole 12*a* for maintaining an air tight sealing.

The chain cover 20 is preferably formed with a coupling surface 26 for coupling to lateral surfaces of the cylinder block 11 and the cylinder head 12. Coupling surface 26 is formed with bolt holes 27 each at a predetermined interval.

When an engine is started, combustion gas and fuel-air mixture is infused into a crankcase to generate blow-by gas. The blow-by gas thus created is introduced to the chain cover 20 to be infused into the passage 22. The blow-by gas having passed through the passage 22 is infused into the head cover 13 through the hole 12*a* at the cylinder head 12. The blow-by gas infused into the head cover 13 is separated from oil as in the prior art where the separated oil is recycled to an oil pan while the gas removed of oil is recycled to a combustion chamber. However, being that the passage 22 is vertically formed, some of the oil contained in the blow-by gas is separated while the blow-by gas flows up. In addition, the chain cover 20 thus formed according to the present invention may be applied to an engine formed with a plurality of blow-by gas holes as in the prior art.

As apparent from the foregoing, there is an advantage in the engine chain cover thus described according to the present invention in that a passage for passing the blow-by gas is formed at one side of a chain cover to shorten the manufacturing process of the cylinder head and to save manufacturing costs. There is another advantage in that some of the oil is separated from the blow-by gas when the blow-by gas passes through the passage of the chain cover to thereby improve the separation efficiency of the oil.

What is claimed is:

1. An engine chain cover defining at one side thereof a passage for inducing blow-by gas collected at a crankcase to flow into an interior portion of a head cover mounted above a cylinder head, wherein the passage is defined by:

a groove vertically formed at one side of the chain cover;

a plate for blocking an open side of the groove to form the passage; and an upper end of the passage communicates with a hole formed at one side of the cylinder head.

2. The engine chain cover as defined in claim 1, wherein the upper end of the passage communicates with an interior portion of the head cover via the hole.

3. The engine chain cover as defined in claim 1, wherein the plate is formed with a plurality of strengthening ribs.

4. The engine chain cover as defined in claim 1, wherein a packing is further provided between the upper end of the passage and the hole.

5. An engine chain cover for an engine including a crankcase and cylinder head, the cover comprising:

an outer cover member having a raised portion to define a groove therein, said raised portion being configured and dimensioned such that when mounted on the engine said groove extends from a position proximate the crankcase to a position proximate the cylinder head;

an inner plate covering said groove to define a blow-by gas passage therethrough, said plate being configured and dimensioned to define an inlet proximate the crankcase and an outlet proximate the cylinder head; and a seal at said outlet adapted to seal against the cylinder head.

6. The engine chain cover of claim 5, further comprising ribs stiffening the plate.

7. The engine chain cover of claim 5 in combination with said engine, further comprising:

a head cover mounted on the cylinder head and defining a space therein; and a hole defined by said cylinder head communicating between the head cover space and the chain cover passage, said seal sealing around said hole, such that blow-by gas may pass from the crankcase through said inlet to the head cover space via the chain cover passage and said hole.

8. The chain cover and engine combination of claim 7, wherein said cylinder head defines a single hole communicating with the chain cover.

* * * * *